US012344916B2

(12) United States Patent
Liu et al.

(10) Patent No.: US 12,344,916 B2
(45) Date of Patent: Jul. 1, 2025

(54) METHOD FOR RECOVERING VALUABLE MATERIAL FROM PEROVSKITE SOLAR CELL

(71) Applicant: National Tsing Hua University, Hsinchu (TW)

(72) Inventors: Fan-Wei Liu, Taichung (TW); Yu-Lun Chueh, Hsinchu (TW); Wei-Sheng Chen, New Taipei (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 499 days.

(21) Appl. No.: 17/883,262

(22) Filed: Aug. 8, 2022

(65) Prior Publication Data

US 2023/0304125 A1 Sep. 28, 2023

(51) Int. Cl.

| | |
|---|---|
| ***C22B 3/00*** | (2006.01) |
| ***C22B 3/06*** | (2006.01) |
| ***C22B 3/26*** | (2006.01) |

(52) U.S. Cl.

CPC ..... *C22B 13/045* (2013.01); *C22B 3/065* (2013.01); *C22B 3/262* (2021.05)

(58) Field of Classification Search

CPC ..... C22B 13/045; C22B 3/262; C22B 3/065

See application file for complete search history.

(56) References Cited

U.S. PATENT DOCUMENTS

2016/0043449 A1 2/2016 Belcher et al.

FOREIGN PATENT DOCUMENTS

| | | | |
|---|---|---|---|
| CN | 106876597 A | * | 6/2017 |
| CN | 108823414 A | | 11/2018 |
| CN | 109943728 A | | 6/2019 |

* cited by examiner

*Primary Examiner* — Ricardo D Morales

(74) *Attorney, Agent, or Firm* — HSML P.C.

(57) ABSTRACT

A method for recovering a valuable material from a perovskite solar cell includes immersing a perovskite solar cell device in an organic solvent to dissolve a monovalent metal cation, a divalent metal cation, and two halogen anions in the organic solvent, followed by adding an oxidizing agent and conducting a heating treatment to form a solid phase residue and a halogen molecule, dissolving the halogen molecule in deionized water to form a halogen solution, rinsing the solid phase residue with deionized water to obtain a solid phase and a liquid phase, calcining the solid phase into a metal oxide, or mixing the solid phase with the halogen solution to obtain a first metal halide, subjecting the liquid phase to an extraction treatment to form an oil phase layer, followed by conducting a back-extraction treatment, adding the halogen solution, and conducting a vacuum concentration treatment to obtain a second metal halide.

9 Claims, 10 Drawing Sheets

METHOD FOR RECOVERING VALUABLE MATERIAL FROM PEROVSKITE SOLAR CELL

CROSS-REFERENCE TO RELATED APPLICATION

This application claims priority of Taiwanese Invention Patent Application No. 111111598, filed on Mar. 28, 2022.

FIELD

The disclosure relates to a method for recovering a valuable material from a perovskite solar cell.

BACKGROUND

The absorbing layer of a perovskite solar cell including an organometallic compound has high light absorption efficiency, and can be separated into electrons and electron holes (that are transferred to the electrodes to generate electric current) after absorbing photons. Therefore, the absorbing layer of the perovskite solar cell has been rapidly developed over the past decade, and has become a promising candidate for third-generation solar cell technology. Compared with Si-based and copper indium gallium selenide (CIGS) thin film solar cells, perovskite solar cells have the advantages of tunable energy gap, strong absorption rate, high conversion efficiency, and low cost, and hence have various advantages for commercialization. However, perovskite solar cells which are commercial might generate a lot of waste and cause environmental pollution.

Many valuable materials (such as lead (Pb), cesium (Cs), bromine (Br), and iodine (I)) present in perovskite solar cells can be used in solar cells as well as in electronics and other industrial products. Lead is scarce and toxic to humans, and halide precursors for the synthesis of absorbing layers of perovskite solar cells are valuable due to limited yields and having high purity. Therefore, in order to reduce the waste of perovskite solar cell devices and to meet the needs of the industry for valuable materials and environmental protection, those skilled in the art still strive to develop an effective way to recover valuable materials from perovskite solar cells.

CN 109943728 A discloses a method for recovering lead from a perovskite solar cell, which includes: (a) stripping of battery components; (b) removal of a hole transport layer; and (c) extraction of a lead-containing compound. In step (a), the substrate material and conductive glass of the perovskite solar cell are peeled off by hand, and then a scotch tape is used to lightly press on the surface of the perovskite solar cell to remove the top electrode. In step (b), the perovskite solar cell is immersed in an ethyl acetate solution, followed by stirring for 1 minute. The perovskite solar cell is taken out and dried under a stream of nitrogen to remove the hole transport layer. In step (c), the perovskite solar cell surface is immersed in distilled water for 1 second. The perovskite solar cell is taken out and placed in a small tube furnace, followed by drying under a stream of nitrogen. Next, the small tube furnace is heated at 150° C. for 10 minutes to decompose methylammonium lead iodide ($CH_3NH_3PbI_3$) in the perovskite solar cell into lead iodide ($PbI_2$) solid. In addition, after the heat treatment, the electron transport layer is in the form of a titanium dioxide ($TiO_2$) solid. Thereafter, the resultant solid mixture containing $PbI_2$ and $TiO_2$ was dissolved in dimethylformamide (DMF), followed by stirring for 2 minutes. After filtration to remove insoluble $TiO_2$ solid, the resultant DMF containing $PbI_2$ is subjected to vacuum distillation to obtain pure $PbI_2$.

CN 108823414 A discloses a method for recycling a waste perovskite solar cell, which includes: (a) immersing a perovskite solar cell in a solvent (such as DMF and dimethylsulfoxide (DMSO)) (which dissolves the perovskite material, but not other components) at a temperature ranging from 25° C. to 80° C. for 5 minutes to 20 minutes, so as to obtain a solution containing soluble perovskite materials and insoluble electrode materials; (b) subjecting the solution to a solid-liquid separation treatment (such as centrifugation and filtration) to obtain a lead-containing supernatant; (c) mixing the lead-containing supernatant with an ammonia solution to obtain a first mixture containing $Pb(OH)_2$; (d) subjecting the first mixture to a solid-liquid separation treatment to obtain a first solid; (e) mixing the first solid with acetic acid to obtain a second mixture; and (f) subjecting the second mixture to a solid-liquid separation treatment and drying in sequence, so as to obtain a $Pb(CH_3COO)_2$ solid with a purity of more than 99.9%.

Although the pure $PbI_2$ obtained by the method of CN 109943728 A and the high-purity $Pb(CH_3COO)_2$ solid obtained by the method of CN 108823414 A can be used as precursors for synthesizing the absorbing layer of the perovskite solar cell, the raw materials recovered by the aforesaid two methods only contain binary elements of Pb and I. In addition, cesium (Cs) and bromine (Br) contained in the absorbing layer of the perovskite solar cell have high industrial utility.

In spite of the aforesaid, there is still a need to develop a method for recovering a valuable material from a perovskite solar cell, which recovers a valuable material containing ternary elements from the perovskite solar cell and reduces the cost of raw materials.

SUMMARY

Accordingly, the present disclosure provides a method for recovering a valuable material from a perovskite solar cell, which can alleviate at least one of the drawbacks of the prior art, and which includes:

(a) immersing a perovskite solar cell device in an organic solvent to separate an absorbing layer containing at least one monovalent metal cation, at least one divalent metal cation, and at least two halogen anions, an electron transport layer, and a transparent conductive layer from the perovskite solar cell device, and to dissolve the at least one monovalent metal cation, the at least one divalent metal cation, and the at least two halogen anions of the absorption layer in the organic solvent;

(b) adding an oxidizing agent to the organic solvent to obtain a mixture containing a halogen molecule formed by oxidation of one of the two halogen anions;

(c) heating the mixture until dry to form a solid phase residue containing the at least one monovalent metal cation, the at least one divalent metal cation, and the other one of the two halogen anions, and to sublime and recover the halogen molecule;

(d) dissolving the recovered halogen molecule in step (c) in deionized water to form a recovered halogen solution;

(e) rinsing the solid phase residue in step (c) with deionized water to obtain a solid phase containing a hydroxide of the divalent metal and a liquid phase containing the at least one monovalent metal cation, the at least one divalent metal cation, and the other one of the two halogen anions;

(f) calcining the solid phase containing the hydroxide of the divalent metal in step (e) into a metal oxide, or dissolving the solid phase containing the hydroxide of the divalent metal in step (e) in an aqueous solution, followed by mixing with the recovered halogen solution in step (d), so as to obtain a first metal halide;

(g) subjecting the liquid phase containing the at least one monovalent metal cation, the at least one divalent metal cation, and the other one of the two halogen anions in step (e) to an extraction treatment with an extractant diluted with an oil, so as to form an oil phase layer containing the at least one monovalent metal cation, and an aqueous phase layer containing the at least one divalent metal cation and the other one of the two halogen anions, wherein the extractant is 4-tert-butyl-2-(α-methylbenzyl)phenol;

(h) subjecting the oil phase layer containing the at least one monovalent metal cation in step (g) to a back-extraction treatment with an ammonium hydroxide solution, so as to obtain an aqueous phase solution containing the at least one monovalent metal cation; and (i) adding the recovered halogen solution in step (d) to the aqueous phase solution containing the at least one monovalent metal cation in step (h), followed by conducting a vacuum concentration treatment, so as to obtain a second metal halide.

BRIEF DESCRIPTION OF THE DRAWINGS

Other features and advantages of the disclosure will become apparent in the following detailed description of the embodiments with reference to the accompanying drawings, of which.

DETAILED DESCRIPTION

FIGS. 1 to 10 respectively illustrate steps (a) to (j) of a method for recovering a valuable material from a perovskite solar cell according to the present disclosure. The details of the steps are described below.

Figure 1:
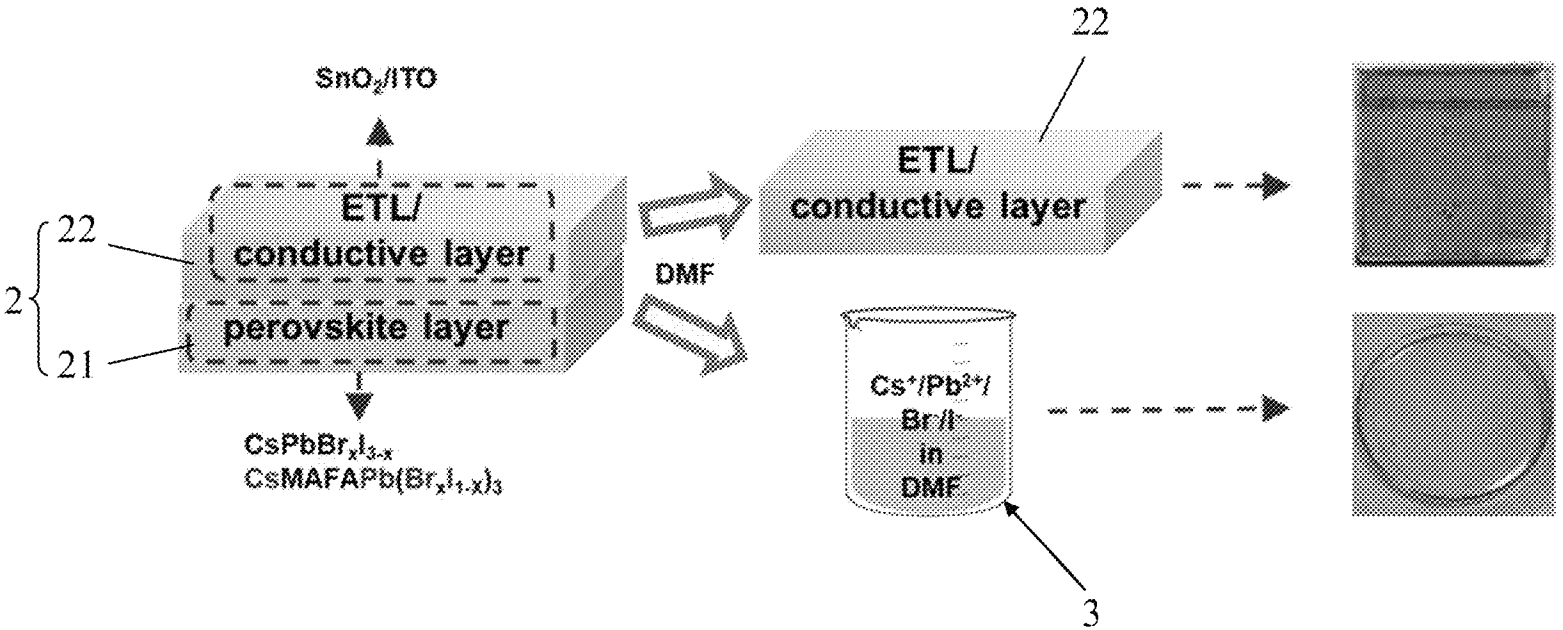
FIG. 1 is a schematic view illustrating step (a) of a method for recovering a valuable material from a perovskite solar cell according to the present disclosure.

Referring to FIG. 1, in step (a), a perovskite solar cell device 2 is immersed in an organic solvent 3 to separate an absorbing layer 21 containing at least one monovalent metal cation, at least one divalent metal cation, and at least two halogen anions, and an electron transport layer (ETL) or a transparent conductive layer 22 from the perovskite solar cell device 2, and to dissolve the at least one monovalent metal cation, the at least one divalent metal cation, and the at least two halogen anions of the absorption layer 21 in the organic solvent 3.

Figure 2:
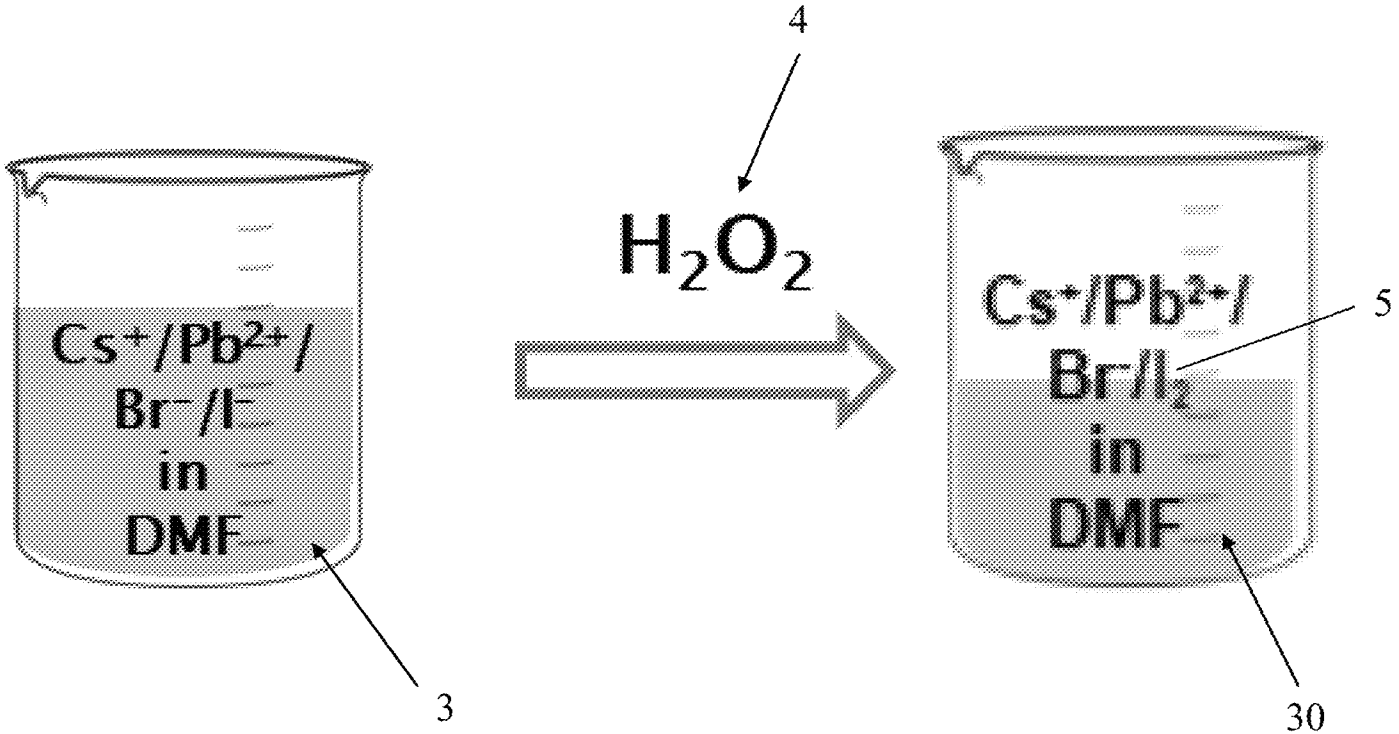
FIG. 2 is a schematic view illustrating step (b) of the method according to the present disclosure.

Referring to FIG. 2, in step (b), an oxidizing agent 4 is added to the organic solvent 3 to obtain a mixture 30 containing a halogen molecule 5 formed by oxidation of one of the two halogen anions.

Figure 3:
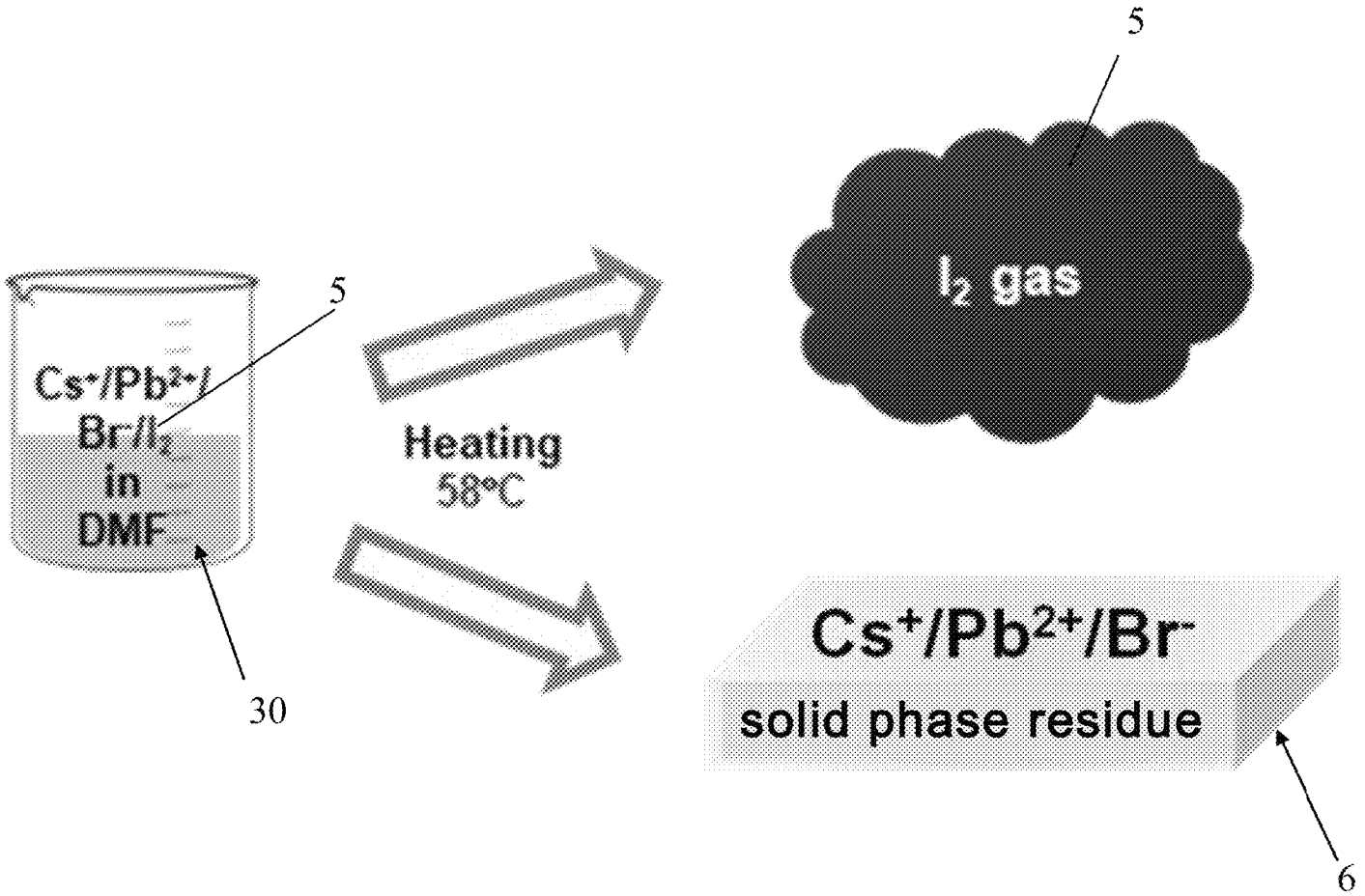
FIG. 3 is a schematic view illustrating step (c) of the method according to the present disclosure.

Referring to FIG. 3, in step (c), the mixture 30 is heated until dry to form a solid phase residue 6 containing the at least one monovalent metal cation, the at least one divalent metal cation, and the other one of the two halogen anions, and to sublime and recover the halogen molecule 5.

Figure 4:
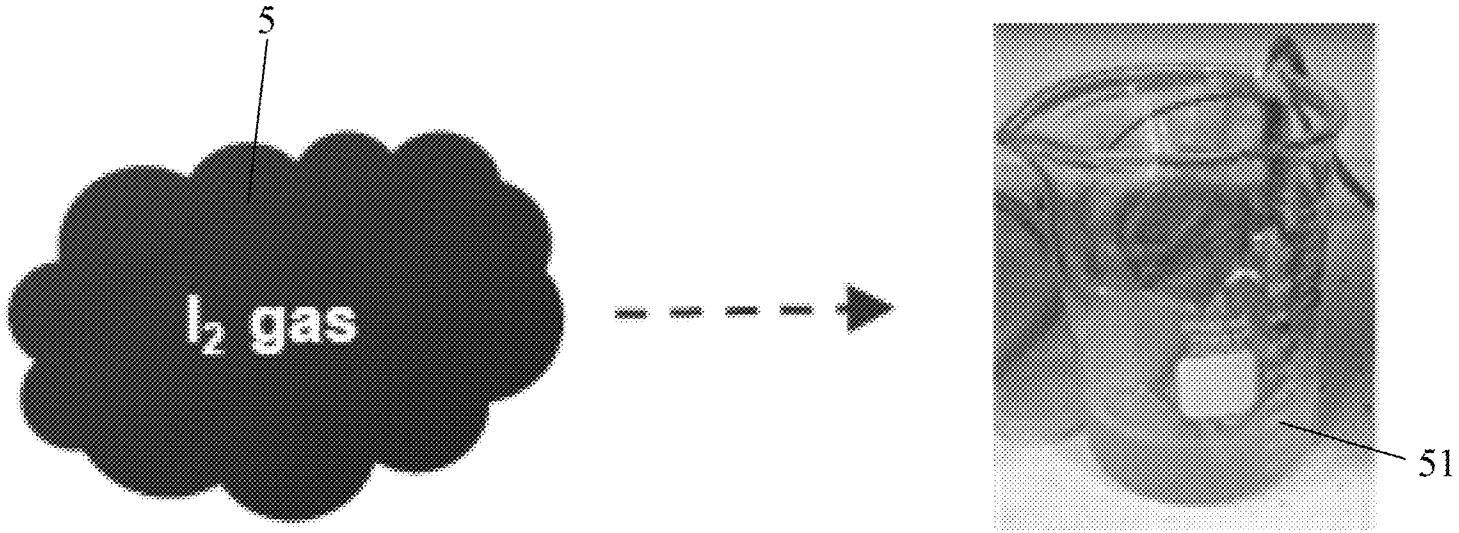
FIG. 4 is a schematic view illustrating step (d) of the method according to the present disclosure.

Referring to FIG. 4, in step (d), the recovered halogen molecule 5 in step (c) is dissolved in deionized water to form a recovered halogen solution 51.

Figure 5:
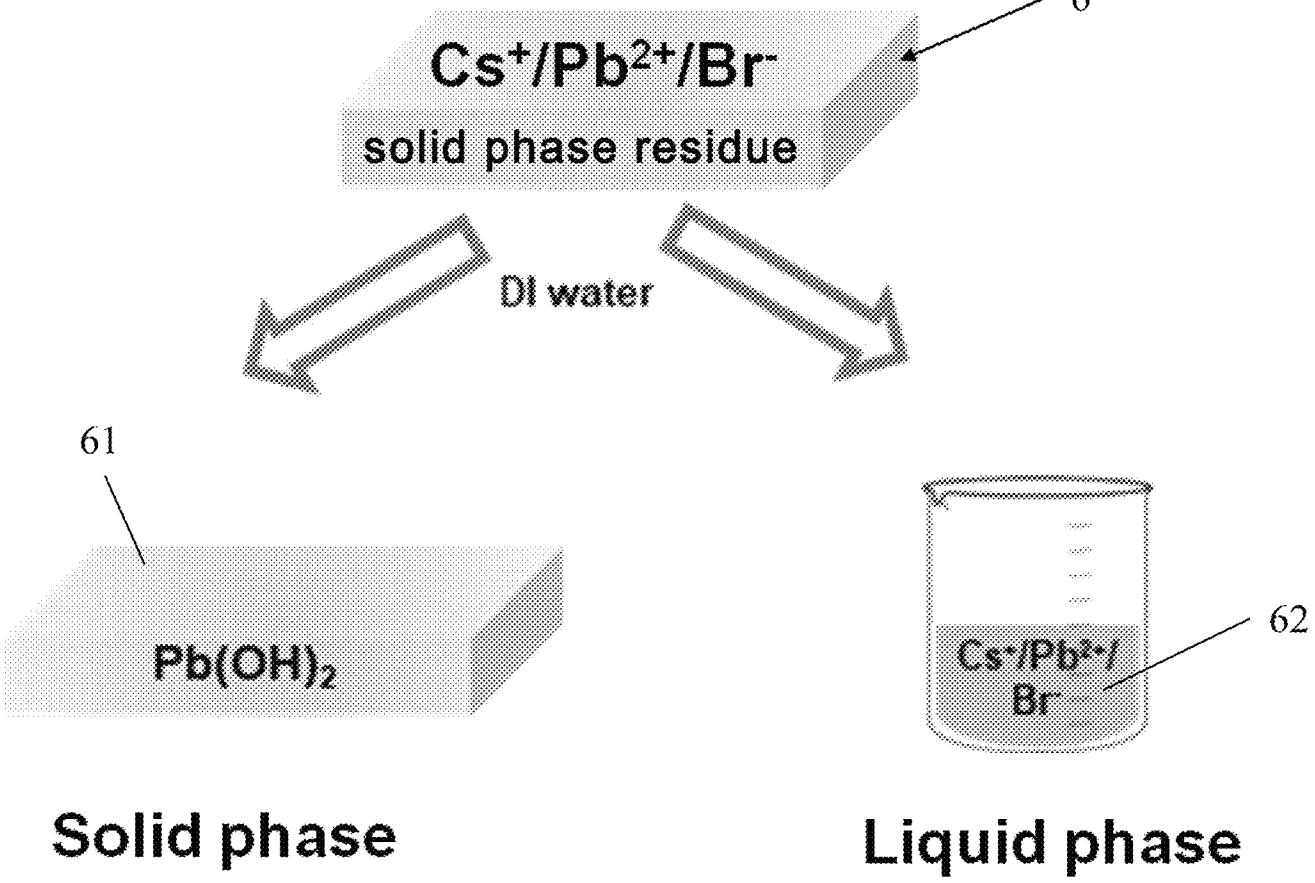
FIG. 5 is a schematic view illustrating step (e) of the method according to the present disclosure.

Referring to FIG. 5, in step (e), the solid phase residue 6 in step (c) is rinsed with deionized water to obtain a solid phase 61 containing a hydroxide of the divalent metal and a liquid phase 62 containing the at least one monovalent metal cation, the at least one divalent metal cation, and the other one of the two halogen anions.

Figure 6:
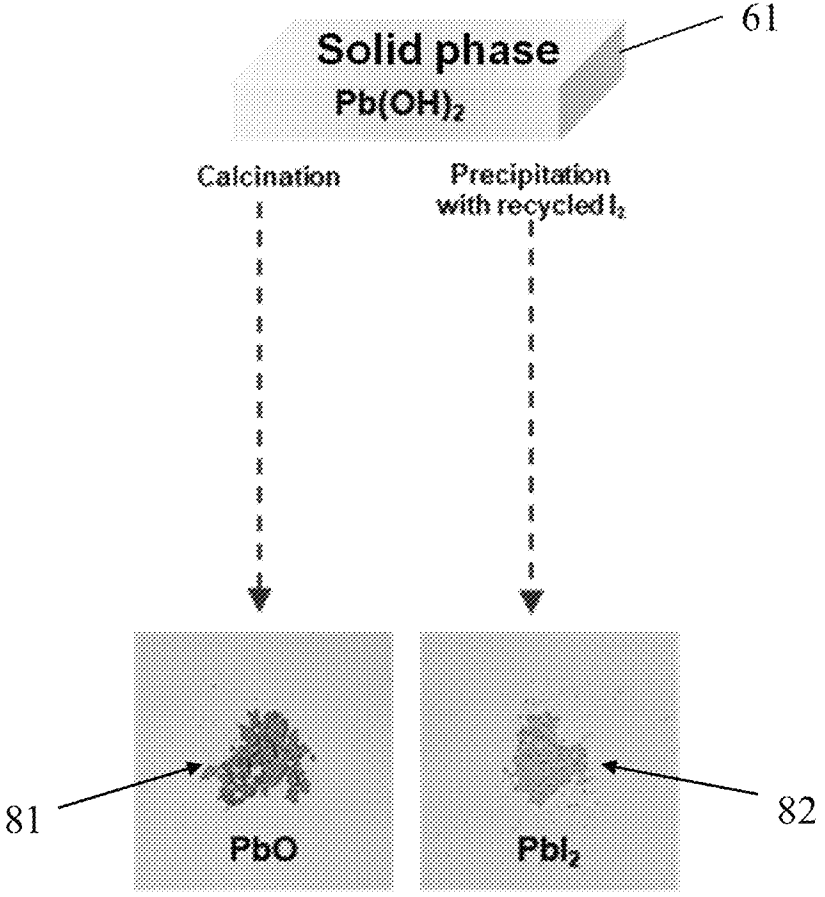
FIG. 6 is a schematic view illustrating step (f) of the method according to the present disclosure.

Referring to FIG. 6, in step (f), the solid phase 61 containing the hydroxide of the divalent metal in step (e) is calcined into a metal oxide 81, or the solid phase 61 containing the hydroxide of the divalent metal in step (e) is dissolved in an aqueous solution (such as an acid aqueous solution), followed by mixing with the recovered halogen solution 51 in step (d), so as to obtain a first metal halide 82.

Figure 7:
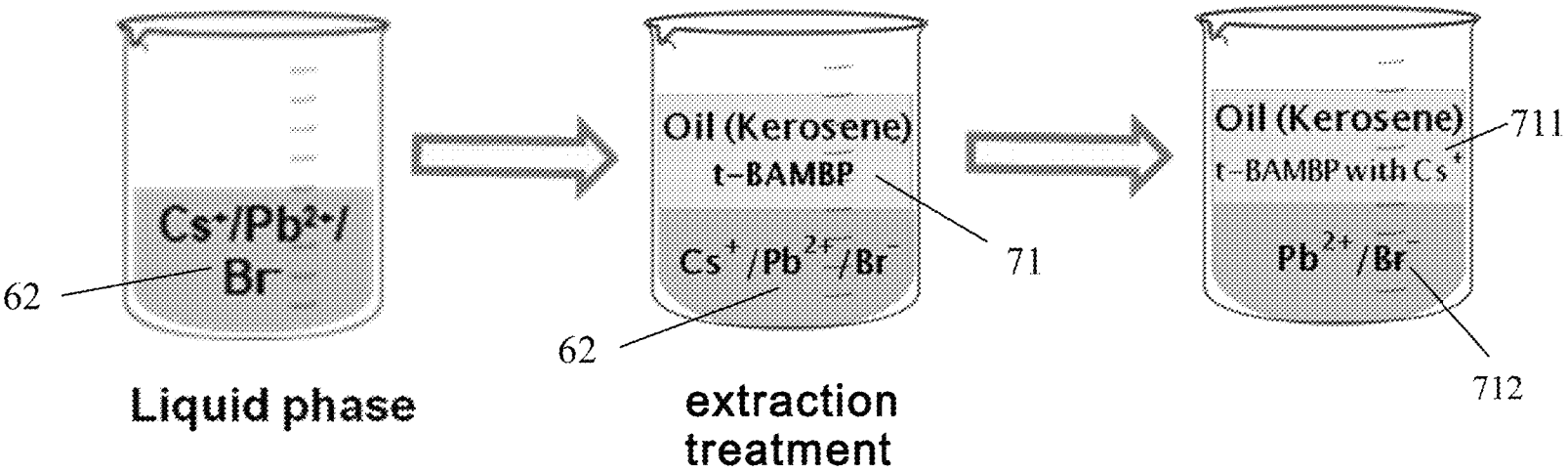
FIG. 7 is a schematic view illustrating step (g) of the method according to the present disclosure.

Referring to FIG. 7, in step (g), the liquid phase 62 containing the at least one monovalent metal cation, the at least one divalent metal cation, and the other one of the two halogen anions in step (e) is subjected to an extraction treatment with an extractant 71 diluted with an oil, so as to form an oil phase layer 711 containing the at least one monovalent metal cation, and an aqueous phase layer 712 containing the at least one divalent metal cation and the other one of the two halogen anions. According to the present disclosure, the extractant 71 is t-BAMBP.

Figure 8:
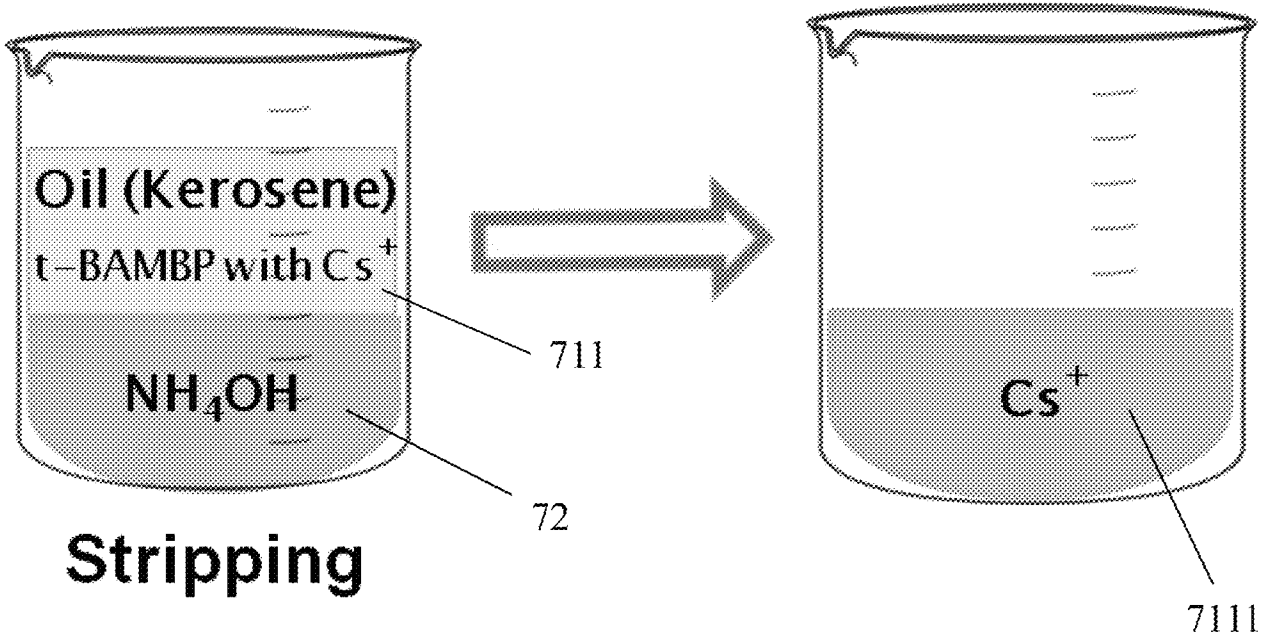
FIG. 8 is a schematic view illustrating step (h) of the method according to the present disclosure.

Referring to FIG. 8, in step (h), the oil phase layer 711 containing the at least one monovalent metal cation in step (g) is subjected to a back-extraction treatment with an ammonium hydroxide ($NH_4OH$) solution 72, so as to obtain an aqueous phase solution 7111 containing the at least one monovalent metal cation.

Figure 9:
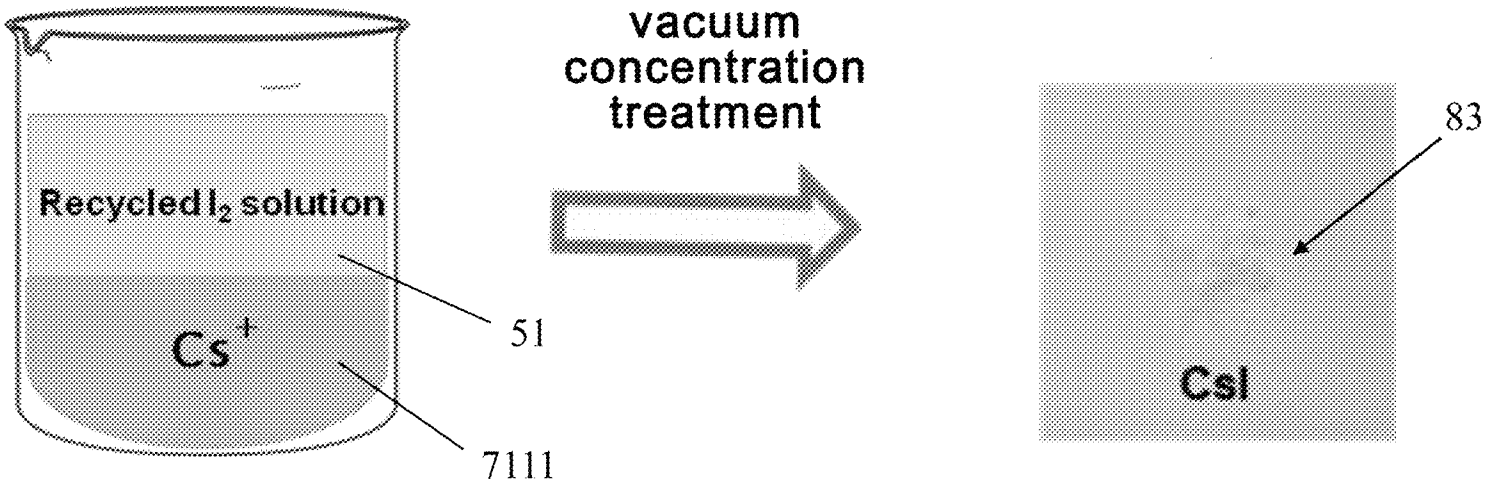
FIG. 9 is a schematic view illustrating step (i) of the method according to the present disclosure.

Referring to FIG. 9, in step (i), the recovered halogen solution 51 in step (d) is added to the aqueous phase solution 7111 containing the at least one monovalent metal cation in step (h), followed by conducting a vacuum concentration treatment, so as to obtain a second metal halide 83.

Figure 10:
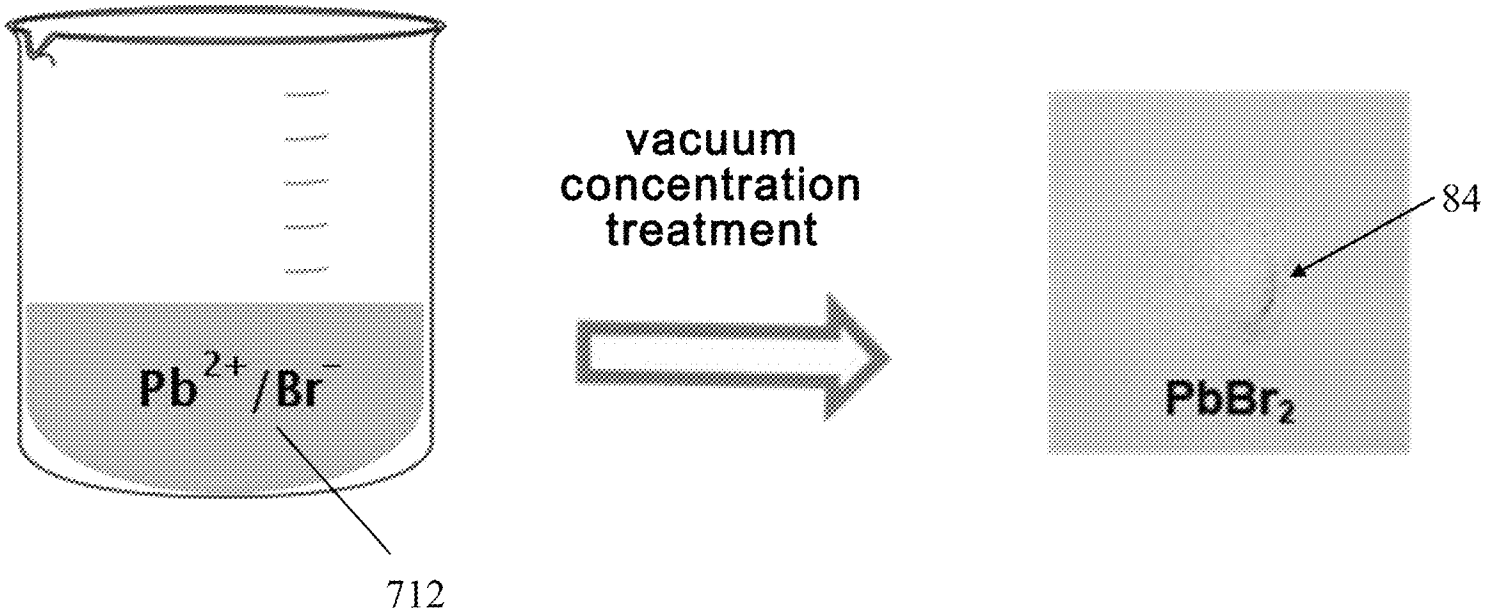
FIG. 10 is a schematic view illustrating step (j) of the method according to the present disclosure.

Referring to FIG. 10, in step (j), the aqueous phase layer 712 containing the at least one divalent metal cation and the other one of the two halogen anions in step (g) is subjected to a vacuum concentration treatment, so as to obtain a third metal halide 84.

In certain embodiments, in step (a), the absorbing layer 21 includes a composition selected from the group consisting of a composition of formula $CsPbBr_XI_{3-X}$, a composition of formula $CsMAFAPb(Br_XI_{1-X})_3$, and a combination thereof, and is subjected to degradation before step (a), the at least one monovalent metal cation and the at least one divalent metal cation are $Cs^+$ and $Pb^{2+}$ respectively, in step (b), the halogen molecule is formed by oxidation of $I^-$, and in step (c), the halogen anion present in the solid phase residue is $Br^-$.

In certain embodiments, the organic solvent 3 in step (a) is dimethylformamide (DMF). Because $I_2$ is easily sublimated into a gas, and the reducing ability of $I^-$ is greater than that of $Br^-$, therefore, in an exemplary embodiment, in step (b), hydrogen peroxide ($H_2O_2$) (serving as an oxidizing agent 4) is added to DMF to obtain a mixture 30 containing $I_2$.

In certain embodiments, the solid phase residue 6 in step (c) contains $Cs^+$, $Pb^{2+}$, and $Br^-$, the halogen molecule 5 in step (c) is $I_2$ vapor, and the recovered halogen solution 51 in step (d) is $I_2$ solution.

In certain embodiments, in step (e), the solid phase 61 contains $Pb(OH)_2$, and the liquid phase 62 contains $Cs^+$, $Pb^{2+}$, and $Br^-$.

In certain embodiments, in step (f), the metal oxide 81 formed by calcining the solid phase 61 in step (e) is PbO, and the first metal halide 82, which is obtained by dissolving the solid phase 61 in step (e) in a nitric acid ($HNO_3$) solution and then mixing with the recovered $I_2$ solution 51 in step (d), is $PbI_2$.

In certain embodiments, in step (g), the extractant (i.e., t-BAMBP) 71 is diluted with kerosene. In an exemplary embodiment, in step (g), the extractant 71 has a concentration ranging from 0.001 mol/L to 0.4 mol/L and a pH value ranging from 5 to 8, and a volume ratio of the oil phase layer 711 to the water phase layer 712 in decimal form ranges from 0.1 to 2.0.

In certain embodiments, in step (g), the extraction treatment is conducted for a time period of not greater than 20 minutes, the oil phase layer 711 contains $Cs^+$, and the water phase layer 712 contains $Pb^{2+}$ and $Br^-$.

In certain embodiments, in step (h), the ammonium hydroxide solution 72 has a concentration ranging from 0.1 mol/L to 2.0 mol/L, a volume ratio of the oil phase layer 711 to the ammonium hydroxide solution 72 in decimal form is not greater than 2.0, and the back-extraction treatment is conducted for a time period ranging from 5 minutes to 25 minutes.

In an exemplary embodiment, in step (h), the aqueous phase solution 7111 contains $Cs^+$, in step (i), the second metal halide 83 is CsI, and in step (j), the third metal halide 84 is $PbBr_2$.

According to the present disclosure, in step (f) and step (i), a metal oxide or a metal halide can be recovered to obtain a valuable binary element material, and in the step (j), a valuable ternary element material can be further recovered.

The present disclosure will be further described by way of the following examples. However, it should be understood that the following examples are intended solely for the purpose of illustration and should not be construed as limiting the present disclosure in practice.

EXAMPLES

Materials

1. Perovskite Solar Cell Device:

Six perovskite solar cell devices were used in the following experiments. Each perovskite solar cell device had a layer structure composed of glass, ITO, $SnO_2$, an electron transport layer (ETL), and an absorbing layer. The absorbing layer included a composition of formula $CsPbBr_XI_{3-X}$ and a composition of formula $CsMAFAPb(Br_XI_{1-X})_3$, and had a size of 1.5 cm×1.5 cm×0.02 cm.

The respective perovskite solar cell device was exposed to the atmosphere for 6 months to allow degradation to proceed before the following experiments were performed.

2. The Solvents Used in the Following Experiments are Listed in Table 1.

TABLE 1

| Solvents | Sources |
|---|---|
| 99.8% of dimethylformamide (DMF) (serving as an organic solvent 3 in step (a)) | J. T. Baker Chemical |
| 34.5% to 36.5% of $H_2O_2$ (serving as an oxidizing agent 4 in step (b)) | Sigma-Aldrich |
| 5 mol/L of nitric acid ($HNO_3$) solution (serving as an aqueous solution in step (f)) | Sigma-Aldrich |
| 4-tert-butyl-2-(α-methylbenzyl)phenol (t-BAMBP) (serving as an extractant 71 in step (g)) | Beijing Ruilekang Separation Technology Co., Ltd. |
| Kerosene (serving as an oil in step (g)) | CPC Corporation, Taiwan |
| Ammonium hydroxide ($NH_4OH$) solution 72 in step (h) | Sigma-Aldrich |

Example 1 (EX1)

Referring to FIG. 1, a respective one of the six degraded perovskite solar cell devices 2 described in section 1 of "Materials" was immersed in 10 mL of DMF for 5 minutes to separate a degraded absorbing layer 21 containing $CsPbBr_XI_{3-X}$: and $CsMAFAPb(Br_XI_{1-X})_3$, an ETL, ITO, and $SnO_2$ from the degraded perovskite solar cell device 2, and to dissolve $Cs^+$, $Pb^{2+}$, $I^-$, and $Br^-$ of the degraded absorbing layer 21 in DMF so as to obtain a DMF solution. The resultant DNF solution was subjected to inductively coupled plasma optical emission spectroscopy (ICP-CES) analysis and ion chromatography (IC) analysis, so as to determine the total content of elements, anions, and cations therein. The experimental result showed that the DMF solution contained 35.38 wt % of Pb, 22.28 wt % of Cs, 24.92 wt % of I, and 17.42 wt % of Br.

Referring to FIG. 2, $H_2O_2$ and the DMF solution were mixed in a volume ratio of 1:10, so as to obtain a mixture 30 containing $I_2$ formed by oxidation of I.

Referring to FIG. 3, the mixture 30 was heated at 58° C. to sublime $I_2$ into $I_2$ vapor 5, followed by recovering $I_2$ vapor 5. Next, the mixture 30 was heated at 100° C. until dry to form a solid phase residue 6 containing $Cs^+$, $Pb^{2+}$, and $Br^-$.

Referring to FIG. 4, the recovered $I_2$ vapor 5 was dissolved in deionized water to form a recovered $I_2$ solution 51. The recovered $I_2$ solution 51 was then subjected to IC analysis. The experimental result showed that the recovered $I_2$ solution 51 contained 0.04 wt % of Pb, 99.8 wt % of I, and 0.02 wt % of Br, and the recovery rate of $I_2$ was 79.19%.

Referring to FIG. 5, the solid phase residue 6 containing $Cs^+$, $Pb^{2+}$, and $Br^-$ was rinsed with deionized water to obtain a solid phase 61 containing $Pb(OH)_2$ and a liquid phase 62 containing $Cs^+$, $Pb^{2+}$, and $Br^-$. Next, the solid phase 61 containing $Pb(OH)_2$ was subjected to ICP-OES analysis, and the experimental result showed that the solid phase 61 contained 94.5 wt % of Pb, 4.22 wt % of I, and 1.28 wt % of Br. The liquid phase 62 containing $Cs^+$, $Pb^{2+}$, and $Br^-$ was subjected to IC analysis, and the experimental result showed that the liquid phase 62 contained 4.01 wt % of Pb, 53.85 wt % of Cs, and 41.12 wt % of Br.

Thereafter, referring to FIG. 6, the solid phase 61 containing $Pb(OH)_2$ was calcined into a PbO powder 81 which could be used as a precursor. Alternatively, the solid phase 61 containing $Pb(OH)_2$ was dissolved in a nitric acid ($HNO_3$) solution, followed by mixing with the recovered $I_2$ solution 51, so as to obtain a $PbI_2$ powder 82 (i.e., a first metal halide) which could be used as a precursor for the manufacture of binary elements (i.e., Pb and I) of an absorbing layer.

The PbO powder 81 and the $PbI_2$ powder 82 were subjected to X-ray diffraction (XRD) analysis. The experimental results showed that the PbO powder 81 and the $PbI_2$ powder 82 had excellent X-ray diffraction patterns (data not shown). In addition, the PbO powder 81 and the $PbI_2$ powder 82 were subjected to ICP-OES analysis. The experimental results showed that the PbO powder 81 contained 98.9 wt % of Pb, 0.39 wt % of Ca, and 0.71 wt % of Na, and the recovery rate of Pb was 95.2%. The $PbI_2$ powder 82 contained 99.7 wt % of Pb, 0.17 wt % of Ca, and 0.13 wt % of Na, and the recovery rate of Pb was 95.3%.

Referring to FIG. 7, the liquid phase 62 containing $Cs^+$, $Pb^{2+}$, and $Br^-$ was subjected to an extraction treatment with t-BAMBP diluted with glycerol, so as to form an oil phase layer 711 containing $Cs^+$, and a water phase layer 712 containing $Pb^{2+}$ and $Br^-$. The operation conditions for the extraction treatment are as follows: t-BAMBP (mol/L): 0.001, 0.01, 0.1, 0.2, and 0.4; pH value: 5, 6, 7, 8, 9, and 10; reaction time (minute): 0.5, 3, 5, 10, 15, and 20; and a volume ratio of the extractant 71 (i.e., the oil phase) to the liquid phase 62 in decimal form: 0.1, 0.25, 0.5, 1, and 2.

The respective resultant oil phase layer 711 containing $Cs^+$ was subjected to Cs extraction rate analysis. The experimental results showed that the volume ratio of the extractant 71 (i.e., the oil phase) to the liquid phase 62 did not affect the extraction rate of Cs, while the extraction rate of Cs was improved with the increase of the pH value, the t-BAMBP concentration, and the reaction time. In particular, the extraction rate of Cs was optimized under specific extraction treatment conditions (i.e., the pH value was 8, the t-BAMBP concentration was 0.2 mol/L, and the reaction time was 15 minutes).

Referring to FIG. 8, the oil phase layer 711 containing $Cs^+$ was subjected to a back-extraction treatment with an ammonium hydroxide ($NH_4OH$) solution 72, so as to obtain an aqueous phase solution 7111 containing $Cs^+$. The operation conditions for the back-extraction treatment are as follows: the concentration of the ammonium hydroxide solution 72 (mol/L): 0.1, 0.2, 0.3, 0.5, 1, and 2; reaction time (minute): 5, 10, 15, 20, and 25; and a volume ratio of the oil phase layer 711 to the ammonium hydroxide solution 72 in decimal form: 0.5, 1, 2, and 4.

The respective resultant aqueous phase solution 7111 containing $Cs^+$ was subjected to Cs back-extraction rate analysis. The experimental results showed that the back-extraction rate of Cs was improved with the increase of the concentration of the ammonium hydroxide solution 72 and the reaction time, while the back-extraction rate of Cs was decreased with the increase of the volume ratio of the oil phase layer 711 to the ammonium hydroxide solution 72. In particular, the back-extraction rate of Cs was optimized under specific back-extraction treatment conditions (i.e., the concentration of the ammonium hydroxide solution 72 was 1 mol/L, the volume ratio of the oil phase layer 711 to the ammonium hydroxide solution 72 in decimal form was 0.5, and the reaction time was 20 minutes).

Referring to FIG. 9, the aqueous phase solution 7111 containing $Cs^+$ was added with the recovered $I_2$ solution 51, followed by conducting a vacuum concentration treatment, so as to obtain a CsI powder 83 (i.e., a second metal halide) which could be used as a precursor for the manufacture of binary elements (i.e., Cs and I) of an absorbing layer.

The CsI powder 83 was then subjected to XRD analysis. The experimental result showed that the CsI powder 83 had an excellent X-ray diffraction pattern (data not shown). In addition, the CsI powder 83 was subjected to ICP-OES analysis. The experimental result showed that the CsI powder 83 contained 0.05 wt % of Pb, 99.83 wt % of Cs, 0.08 wt % of Ca, and 0.04 wt % of Na, and the recovery rate of Cs was 99.7%.

Referring to FIG. 10, the water phase layer 712 containing $Pb^{2+}$ and $Br^-$ was subjected to a vacuum concentration treatment, so as to obtain a $PbBr_2$ powder 84 (i.e., a third metal halide) which could be used as a precursor for the manufacture of binary elements (i.e., Pb and Br) of an absorbing layer.

The $PbBr_2$ powder 84 was then subjected to XRD analysis. The experimental result showed that the $PbBr_2$ powder 84 had an X-ray diffraction pattern (data not shown). In addition, the $PbBr_2$ powder 84 was subjected to ICP-OES analysis. The experimental result showed that the $PbBr_2$ powder 84 contained 99.58 wt % of Pb, 0.2 wt % of Ca, and 0.22 wt % of Na, and the recovery rate of Pb was 4.67%.

The total Pb recovery rate of the PbO powder 81 (the recovery rate of Pb was 95.2%) and the $PbBr_2$ powder 84 (the recovery rate of Pb was 4.67%) was 99.87%, and the total Pb recovery rate of the $PbI_2$ powder 82 (the recovery rate of Pb was 95.3%) and the $PbBr_2$ powder 84 (the recovery rate of Pb was 4.67%) was 99.97%.

Summarizing the above results, it is clear that the method for recovering a valuable material from a perovskite solar cell of the present disclosure can effectively recover quaternary element powders (i.e., the PbO powder 81, the $PbI_2$ powder 82, the CsI powder 83, and the $PbBr_2$ powder 84) from the absorbing layer 21 of the perovskite solar cell device 2, and these powders are expensive precursors for making absorbing layers of perovskite solar cells.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A method for recovering a valuable material from a perovskite solar cell, comprising:

(a) immersing a perovskite solar cell device in an organic solvent to separate an absorbing layer containing at least one monovalent metal cation, at least one divalent metal cation, and at least two halogen anions, an electron transport layer, and a transparent conductive layer from the perovskite solar cell device, and to dissolve the at least one monovalent metal cation, the at least one divalent metal cation, and the at least two halogen anions of the absorbing layer in the organic solvent;

(b) adding an oxidizing agent to the organic solvent to obtain a mixture containing a halogen molecule formed by oxidation of one of the two halogen anions;

(c) heating the mixture until dry to form a first solid phase residue containing the at least one monovalent metal cation, the at least one divalent metal cation, and the other one of the two halogen anions, and to sublime and recover the halogen molecule;

(d) dissolving the recovered halogen molecule in step (c) in deionized water to form a recovered halogen solution;

(e) rinsing the first solid phase residue in step (c) with deionized water to obtain a second solid phase residue containing a hydroxide of the divalent metal and a liquid phase containing the at least one monovalent metal cation, the at least one divalent metal cation, and the other one of the two halogen anions;

(f) calcining the second solid phase residue containing the hydroxide of the divalent metal in step (e) into a metal oxide, or dissolving the second solid phase residue containing the hydroxide of the divalent metal in step (e) in an aqueous solution, followed by mixing with the recovered halogen solution in step (d), so as to obtain a first metal halide;

(g) subjecting the liquid phase containing the at least one monovalent metal cation, the at least one divalent metal cation, and the other one of the two halogen anions in step (e) to an extraction treatment with an extractant diluted with an oil, so as to form an oil phase layer containing the at least one monovalent metal cation, and a water phase layer containing the at least one divalent metal cation and the other one of the two halogen anions, wherein the extractant is 4-tert-butyl-2-(α-methylbenzyl) phenol;

(h) subjecting the oil phase layer containing the at least one monovalent metal cation in step (g) to a back-extraction treatment with an ammonium hydroxide solution, so as to obtain an aqueous phase solution containing the at least one monovalent metal cation; and (i) adding the recovered halogen solution in step (d) to the aqueous phase solution containing the at least one monovalent metal cation in step (h), followed by conducting a vacuum concentration treatment, so as to obtain a second metal halide.

2. The method according to claim 1, further comprising:

(j) subjecting the water phase layer containing the at least one divalent metal cation and the other one of the two halogen anions in step (g) to a vacuum concentration treatment, so as to obtain a third metal halide.

3. The method according to claim 1, wherein in step (a), the absorbing layer includes a composition selected from the group consisting of a composition of formula $CsPbBr_XI_{3-x}$, a composition of formula CsMAFAPb $(Br_XI_{1-X})_3$, and a combination thereof, and is subjected to degradation before step (a), the at least one monovalent metal cation and the at least one divalent metal cation are $Cs^+$ and $Pb^{2+}$ respectively, in step (b), the halogen molecule is formed by oxidation of $I^-$, and in step (c), the halogen anion present in the first solid phase residue is $Br^-$.

4. The method according to claim 3, wherein the organic solvent in step (a) is dimethylformamide, the oxidizing agent in step (b) is hydrogen peroxide, the first solid phase residue in step (c) contains $Cs^+$, $Pb^{2+}$, and $Br^-$, the halogen molecule in step (c) is $I_2$ vapor, and the recovered halogen solution in step (d) is $I_2$ solution.

5. The method according to claim 4, wherein in step (e), the second solid phase residue contains $Pb(OH)_2$, and the liquid phase contains $Cs^+$, $Pb^{2+}$, and $Br^-$.

6. The method according to claim 5, wherein in step (f), the metal oxide formed by calcining the second solid phase residue in step (e) is PbO, and the first metal halide, which is obtained by dissolving the second solid phase residue in step (e) in a nitric acid solution and then mixing with the recovered $I_2$ solution in step (d), is $PbI_2$.

7. The method according to claim 6, wherein in step (g), the extractant is diluted with kerosene and has a concentration ranging from 0.001 mol/L to 0.4 mol/L and a pH value ranging from 5 to 8, a volume ratio of the oil phase layer to the water phase layer in decimal form ranges from 0.1 to 2.0, the extraction treatment is conducted for a time period of not greater than 20 minutes, the oil phase layer contains $Cs^+$, and the water phase layer contains $Pb^{2+}$ and $Br^-$.

8. The method according to claim 7, wherein in step (h), the ammonium hydroxide solution has a concentration ranging from 0.1 mol/L to 2.0 mol/L, a volume ratio of the oil phase layer to the ammonium hydroxide solution in decimal form is not greater than 2.0, the back-extraction treatment is conducted for a time period ranging from 5 minutes to 25 minutes, the aqueous phase solution contains $Cs^+$, and in step (i), the second metal halide is CsI.

9. The method according to claim 7, further comprising:

(j) subjecting the water phase layer containing $Pb^{2+}$ and $Br^-$ in step (g) to a vacuum concentration treatment, so as to obtain $PbBr_2$.

* * * * *